US011480024B2

(12) United States Patent
Anderson

(10) Patent No.: US 11,480,024 B2
(45) Date of Patent: Oct. 25, 2022

(54) PACKER ASSEMBLY WITH SLIP SYSTEM

(71) Applicant: Gary Anderson, Dublin, OH (US)

(72) Inventor: Gary Anderson, Dublin, OH (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/188,529

(22) Filed: Mar. 1, 2021

(65) Prior Publication Data

US 2022/0275701 A1 Sep. 1, 2022

(51) Int. Cl.
*E21B 33/129* (2006.01)

(52) U.S. Cl.
CPC ..... *E21B 33/129* (2013.01)

(58) Field of Classification Search
CPC ..... E21B 33/12; E21B 33/128; E21B 33/129; E21B 23/004; E21B 23/06
See application file for complete search history.

(56) References Cited

U.S. PATENT DOCUMENTS 3,343,607 A * 9/1967 Current ..... E21B 33/1216 166/134
2018/0313179 A1* 11/2018 Kandaswami ..... E21B 23/01

* cited by examiner

*Primary Examiner* — D. Andrews
*Assistant Examiner* — Ronald R Runyan
(74) *Attorney, Agent, or Firm* — Cantor Colburn LLP

(57) ABSTRACT

A slip engagable with a slip ring including a head section having an arc length, a tail section having the same arc length, an intermediate section having an arc length shorter than either the head section and the tail section connecting the head section to the tail section, and a lateral wing depending from the intermediate section.

17 Claims, 6 Drawing Sheets

PACKER ASSEMBLY WITH SLIP SYSTEM

BACKGROUND

In the resource recovery industry, slips are used to anchor tools such as packers, etc. within tubular structures such as casing and open hole. There are many kinds of slips available to the art, but each still has drawbacks in certain situations that operators would be happy to avoid. In view hereof, alternative arrangements that avoid drawbacks for particular situations are always well received by the art.

SUMMARY

An embodiment of a slip engagable with a slip ring including a head section having an arc length, a tail section having the same arc length, an intermediate section having an arc length shorter than either the head section and the tail section connecting the head section to the tail section, and a lateral wing depending from the intermediate section.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
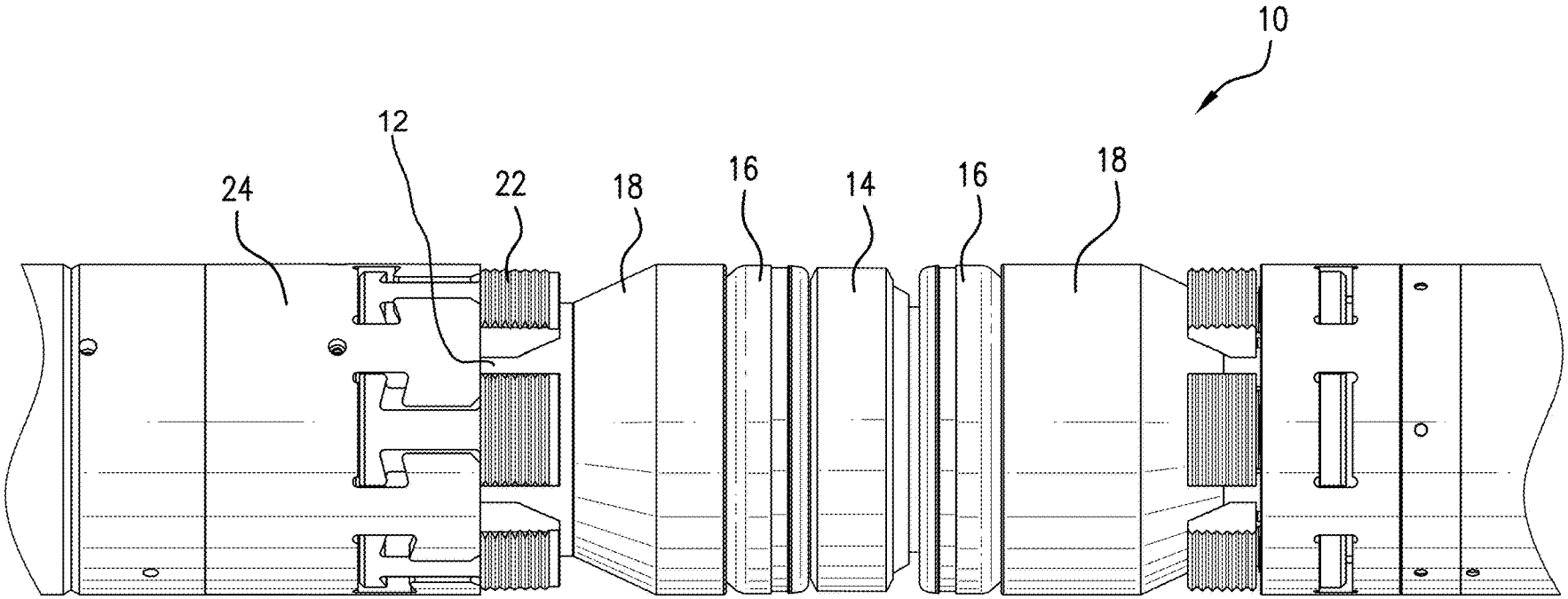
FIG. 1 is a view of a packer assembly having a slip system as disclosed herein.

Referring to FIG. 1, a packer assembly 10 is illustrated. The assembly 10 includes a mandrel 12; a packer element 14 disposed upon the mandrel 12; a backup 16 at one or both ends of the element 14; a cone(s) 18; adjacent the backup(s) 16 and a slip system 20 adjacent the cone(s) 18. The packer assembly 10 is robust yet facilitates retrieval.

Figure 2:
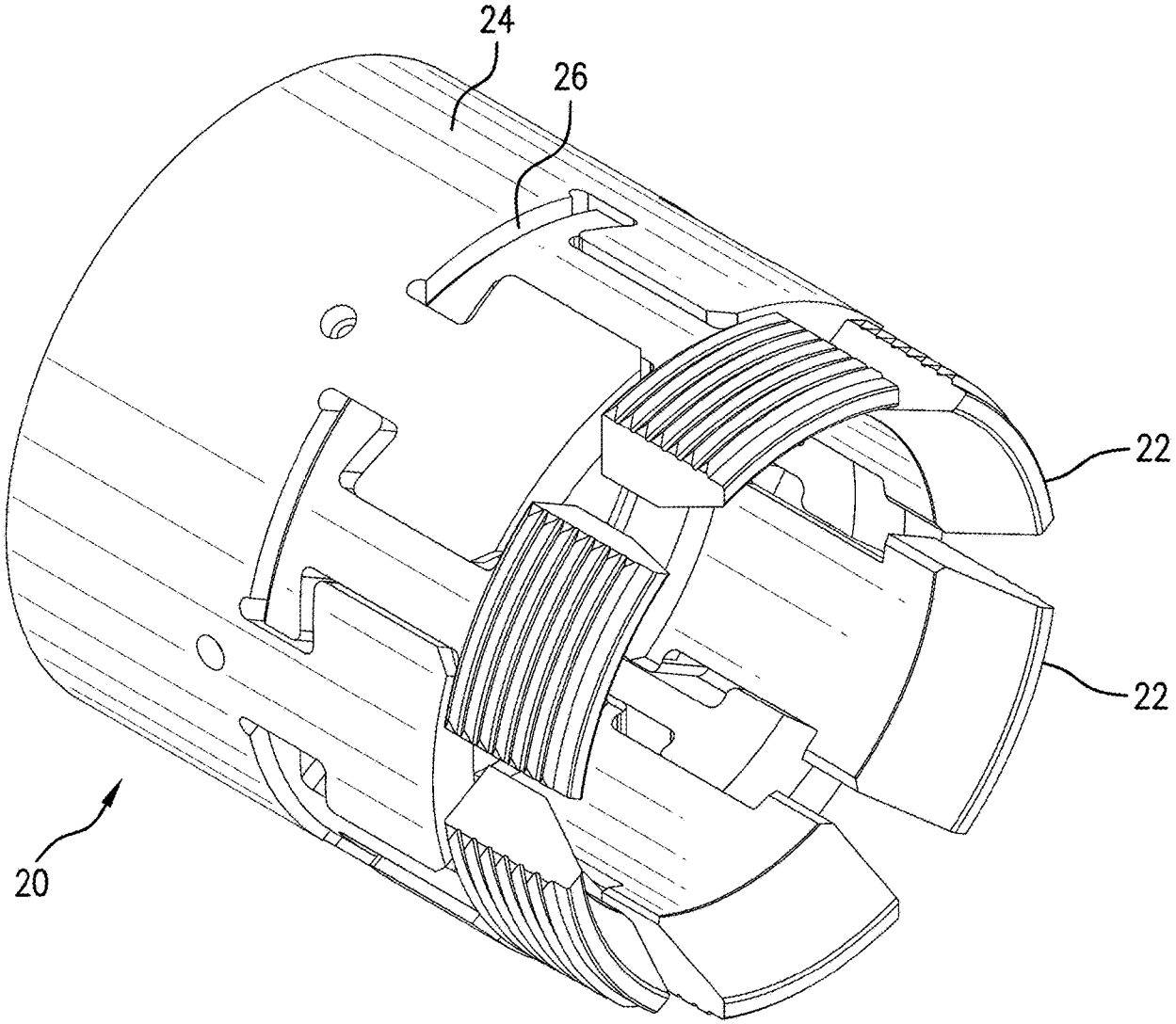
FIG. 2 is a perspective view of the slip system portion of FIG. 1.

Referring to FIG. 2, the slip system 20 is illustrated apart from other portions of the assembly 10. The system 20 includes a slip 22. As illustrated, 6 slips 22 are used but more or fewer are contemplated. Each slip 22 is interactive with a slip ring 24. The slip ring 24 includes openings 26 that receive the slips 22 in an axially sliding manner.

Figure 3:
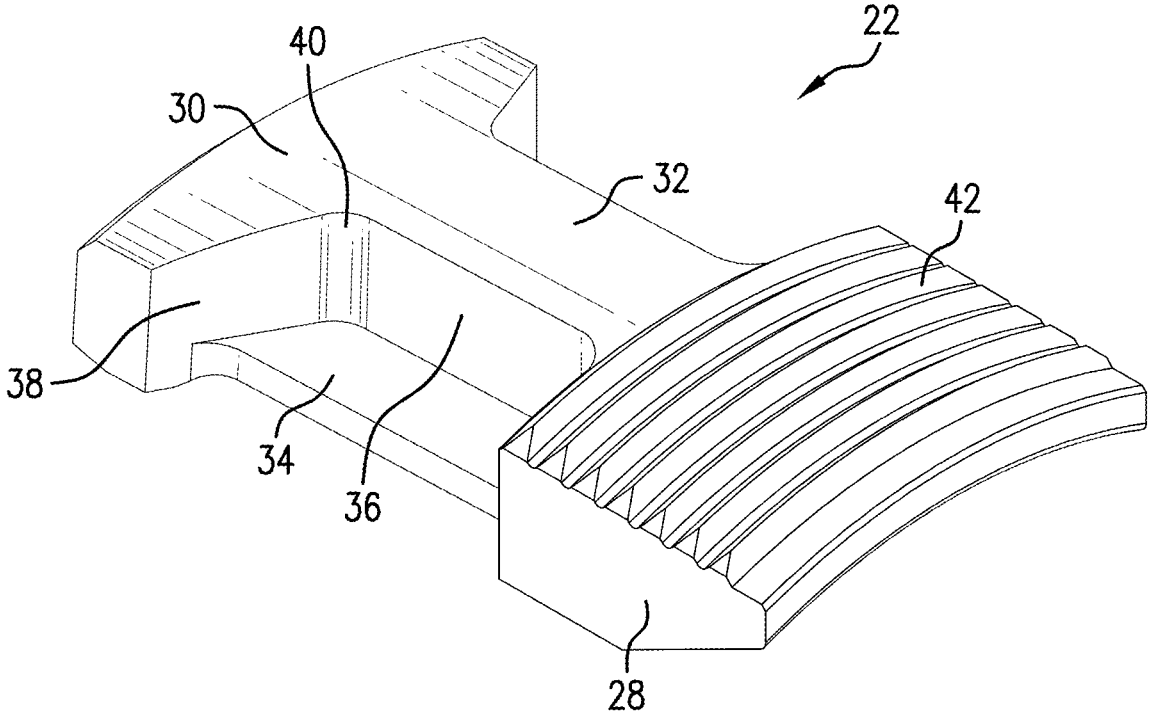
FIG. 3 is a perspective view of a slip from the system of FIG. 2.

Referring to FIG. 3, a slip 22 is illustrated alone. Understanding the features thereof will provide a framework for the interaction of the slip 22 with the ring 24. Slip 22 includes a head section 28, a tail section 30 and an intermediate section 32 that connects the head section 28 and the tail section 30. Lateral wings 34 extend laterally from side surfaces 36 of the intermediate section 32 and extend longitudinally to the head and tail sections. In the illustration of FIG. 3, it can be seen that a surface 38 of tail section 30 forms an oblique angle with the surface 36 in an embodiment. In another embodiment, the surface 38*a* (see FIG. 4) forms an acute angle with the surface 36. The differences in these is related to considerations for different uses where it may be desirable to increase the length of the lateral wing 34 (that of FIG. 4) or reduce a stress riser at intersection 40 (that of FIG. 3). Either or the embodiments of slip 22 illustrated may also include wickers 42.

Figure 4:
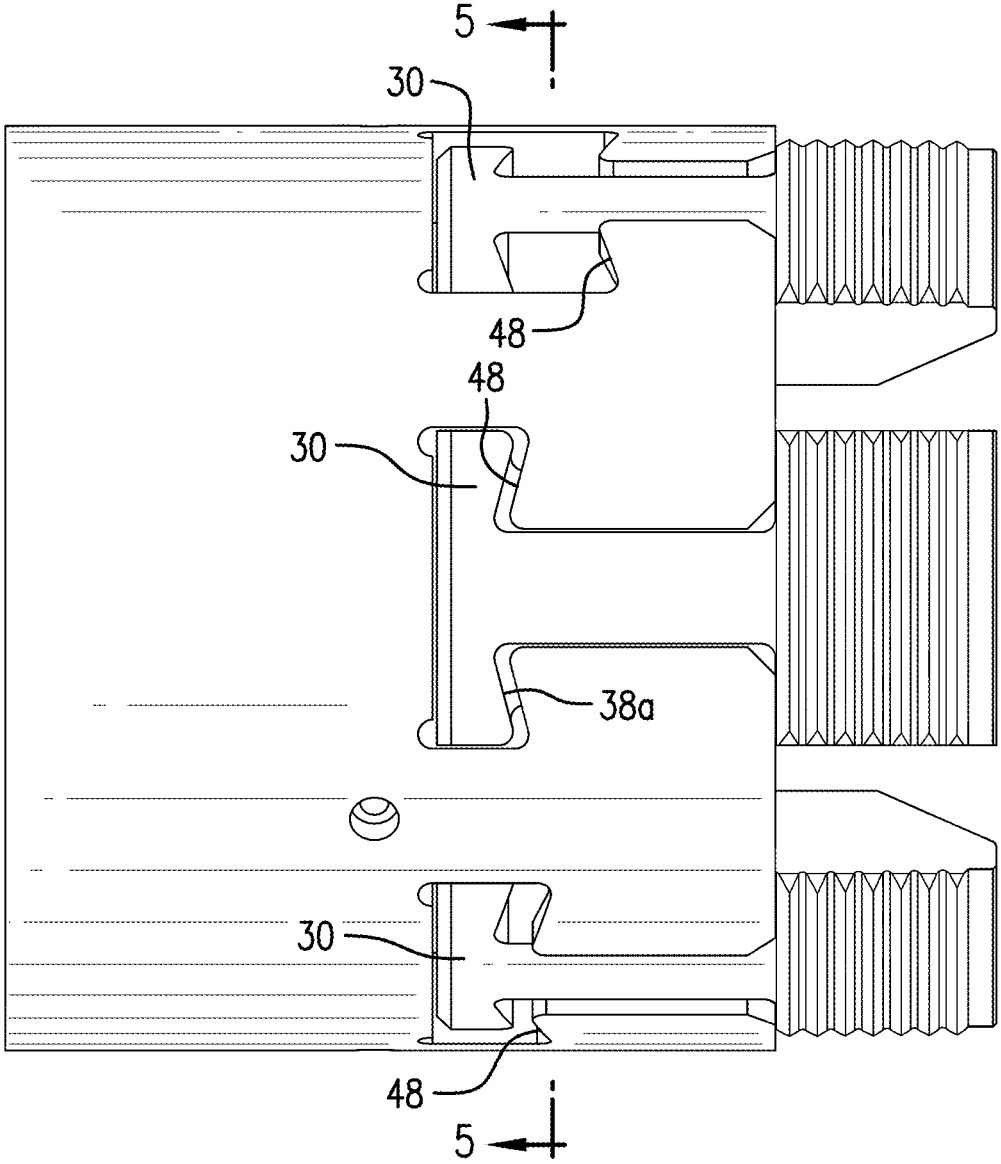
FIG. 4 is a side view of the slip system.
Figure 5:
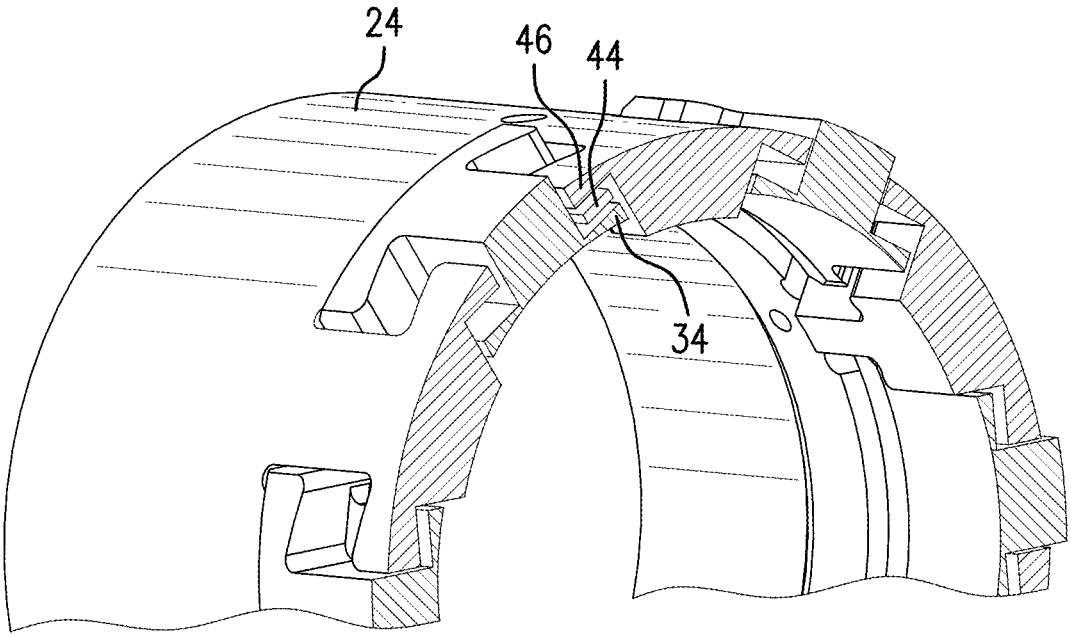
FIG. 5 is a cross section view of FIG. 4 taken along section line 5-5.

Referring to FIG. 5, a perspective cross section view taken along section line 5-5 in FIG. 4 provides understanding of the interaction of the slip 22 and the ring 24 to maintain the slip 22 in position during run in and retrieval. Also visible is a resilient member 44 that in some embodiments is a leaf spring disposed between lateral wing 34 and ring extensions 46.

It is to be noted that the ring 24 may be configured for timed slip disengagement. This is accomplished by varying the spacing between the tail section 30 and ring pull surfaces 48 among various openings 26 in the ring 24.

Figure 6:
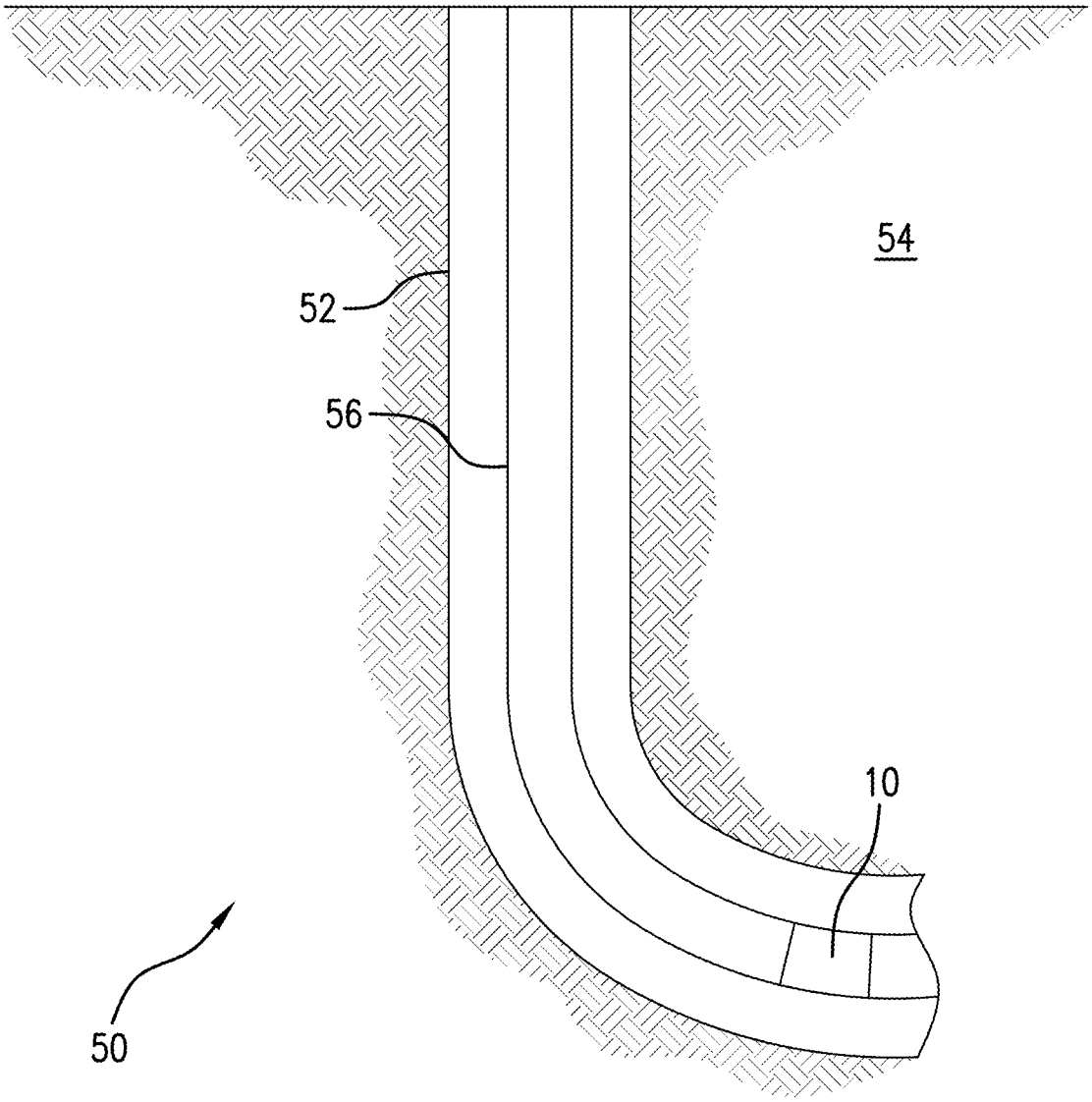
FIG. 6 is an elevation view of a wellbore system including the packer and slip system as disclosed herein.

Referring to FIG. 6, a wellbore system 50 includes a borehole 52 disposed in a subsurface formation 54. The borehole may be open or cased and a tool such as a packer assembly 10 having the slip system as disclosed herein is disposed on a tubing string 56 and engageable with the casing or open hole.

Set forth below are some embodiments of the foregoing disclosure:

Embodiment 1: A slip engagable with a slip ring including a head section having an arc length, a tail section having an arc length, an intermediate section having an arc length shorter than either the head section and the tail section connecting the head section to the tail section, and a lateral wing depending from the intermediate section.

Embodiment 2: The slip as in any prior embodiment, wherein the head section further includes wickers.

Embodiment 3: The slip as in any prior embodiment, wherein the lateral wing extends from a lateral side of the intermediate section and terminates short of the arc length of the head and tail sections.

Embodiment 4: The slip as in any prior embodiment, wherein the intermediate section is of the same radial thickness as the head and tail sections.

Embodiment 5: The slip as in any prior embodiment, wherein the lateral wing is of smaller radial thickness than the intermediate section.

Embodiment 6: The slip as in any prior embodiment, wherein the tail section includes a surface that is at an oblique angle with a lateral surface of the intermediate section.

Embodiment 7: The slip as in any prior embodiment, wherein the tail section includes a surface that is at an acute angle with a lateral surface of the intermediate section.

Embodiment 8: A slip system including a slip as in any prior embodiment, and a slip ring having openings mimicking a shape of the tail and intermediate sections.

Embodiment 9: The system as in any prior embodiment, wherein the openings include a ring extension that overlaps the lateral wing when the slip is installed in the slip ring.

Embodiment 10: The system as in any prior embodiment, wherein a resilient member is disposed between the ring extension and the lateral wing.

Embodiment 11: The system as in any prior embodiment, wherein the openings are configured for a timed unsetting where a plurality of slips are present.

Embodiment 12: A packer system including a mandrel, a packer element disposed upon the mandrel, a cone adjacent the backup and a slip system adjacent the cone, and a slip system as in any prior embodiment.

Embodiment 13: The system as in any prior embodiment further including a backup at one or both ends of the element.

Embodiment 14: A wellbore system including a borehole in a subsurface formation, and a packer system as in any prior embodiment in the borehole.

Embodiment 15: The wellbore system as in any prior embodiment further comprising a string in the borehole, the string connected to the packer system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip engagable with a slip ring comprising:
a head section having an arc length;
a tail section having an arc length;
an intermediate section having an arc length shorter than either the head section and the tail section connecting the head section to the tail section; and
a lateral wing depending from the intermediate section, wherein the lateral wing extends from a lateral side of the intermediate section and terminates short of the arc length of the head and tail sections.

2. The slip as claimed in claim 1 wherein the head section further includes wickers.

3. The slip as claimed in claim 1 wherein the intermediate section is of the same radial thickness as the head and tail sections.

4. The slip as claimed in claim 1 wherein the lateral wing is of smaller radial thickness than the intermediate section.

5. The slip as claimed in claim 1 wherein the tail section includes a surface that is at an oblique angle with a lateral surface of the intermediate section.

6. The slip as claimed in claim 1 wherein the tail section includes a surface that is at an acute angle with a lateral surface of the intermediate section.

7. A slip system comprising:
a slip as claimed in claim 1; and
a slip ring having openings mimicking a shape of the tail and intermediate sections.

8. The system as claimed in claim 7 wherein the openings include a ring extension that overlaps the lateral wing when the slip is installed in the slip ring.

9. The system as claimed in claim 8 wherein a resilient member is disposed between the ring extension and the lateral wing.

10. The system as claimed in claim 7 wherein the openings are configured for a timed unsetting where a plurality of slips are present.

11. A packer system comprising:
a mandrel;
a packer element disposed upon the mandrel, the packer element having two ends;
a cone adjacent a backup adjacent one of the two ends and a slip system as claimed in claim 1 adjacent the cone.

12. The system as claimed in claim 11 further including an additional backup at the other of the two ends of the element.

13. A wellbore system comprising:
a borehole in a subsurface formation; and
a packer system as claimed in claim 12 in the borehole.

14. The wellbore system as claimed in claim 13 further comprising a string in the borehole, the string connected to the packer system.

15. A slip system comprising:
a slip having:
a head section having an arc length;
a tail section having an arc length;
an intermediate section having an arc length shorter than either the head section and the tail section connecting the head section to the tail section;
a lateral wing depending from the intermediate section; and
a slip ring having openings mimicking a shape of the tail and intermediate sections, wherein the openings include a ring extension that overlaps the lateral wing when the slip is installed in the slip ring.

16. The system as claimed in claim 15 wherein a resilient member is disposed between the ring extension and the lateral wing.

17. A slip system comprising:
a slip having:
a head section having an arc length;
a tail section having an arc length;
an intermediate section having an arc length shorter than either the head section and the tail section connecting the head section to the tail section;
a lateral wing depending from the intermediate section; and a slip ring having openings mimicking a shape of the tail and intermediate sections, wherein the openings are configured for a timed unsetting where a plurality of slips are present.

* * * * *